US006209314B1

(12) United States Patent
Staufenberg

(10) Patent No.: US 6,209,314 B1
(45) Date of Patent: Apr. 3, 2001

(54) AIR/FUEL MIXTURE CONTROL IN AN INTERNAL COMBUSTION ENGINE

(75) Inventor: Ulrich Staufenberg, Wanaka (NZ)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/254,053

(22) PCT Filed: Jun. 18, 1997

(86) PCT No.: PCT/EP97/03166

§ 371 Date: Feb. 26, 1999

§ 102(e) Date: Feb. 26, 1999

(87) PCT Pub. No.: WO98/10183

PCT Pub. Date: Mar. 12, 1998

(30) Foreign Application Priority Data

Sep. 7, 1996 (DE) ..... 196 36 465

(51) Int. Cl.[7] ..... F01N 3/00
(52) U.S. Cl. ..... 60/274; 60/277
(58) Field of Search ..... 60/274, 276, 285, 60/277; 73/118.1

(56) References Cited

U.S. PATENT DOCUMENTS 4,796,425 1/1989 Nagai et al. .
5,134,847 8/1992 Ogawa et al. .
5,255,515 * 10/1993 Blumenstock et al. ..... 60/274
5,307,625 * 5/1994 Junginger et al. ..... 60/274
5,335,538 * 8/1994 Blischke et al. ..... 73/118.1
5,379,591 * 1/1995 Iwata et al. ..... 60/276
5,836,153 * 11/1998 Staufenberg et al. ..... 60/274
5,839,274 * 11/1998 Remboski et al. ..... 60/274

OTHER PUBLICATIONS

Patent Abstracts of Japan vol. 007, No. 165 (M–230), Jul. 20, 1983 & JP 58 072647 A (Toyota Jidosha Kogyo KK), Apr. 30, 1983.
Patent Abstracts of Japan vol. 007, No. 133 (M–221), Jun. 10, 1983 & Jp 58 048755 A (Toyota Jidosha Kogyo KK), Mar. 22, 1983.

* cited by examiner

*Primary Examiner*—Teresa Walberg
*Assistant Examiner*—Quang Van
(74) *Attorney, Agent, or Firm*—Martin A. Farber

(57) ABSTRACT

A method for regulating the fuel/air ratio of an internal combustion engine, the output signal from a first lamba probe, which is arranged in the exhaust duct of the internal combustion engine upstream of a catalyst, being supplied to a controller, and the controller emitting a manipulated variable for the fuel/air ratio, and there being supplied to the controller a correcting signal which is obtained from the output signal from a second lambda probe located downstream of the catalyst.

In order to allow accurate and adapatable regulation which further improves the fuel/air ratio with the effect of a reduction in the exhaust gas emission, the correcting signal is weighted as a function of the period of the output signal from the first lambda probe.

6 Claims, 4 Drawing Sheets

AIR/FUEL MIXTURE CONTROL IN AN INTERNAL COMBUSTION ENGINE

FIELD AND BACKGROUND OF THE INVENTION

The invention relates to a method for regulating the fuel/air ratio of an internal combustion engine, the output signal from a first lambda probe, which is arranged in the exhaust duct of the internal combustion engine upstream of a catalyst, being supplied to the controller, and the controller emitting a manipulated variable for the fuel/air ratio, and there being supplied to the controller a correcting signal which is obtained from the output signal from a second lambda probe located downstream of the catalyst.

In order to achieve exhaust gases which are as free of pollutants as possible, regulating devices for internal combustion engines are known, in which the oxygen content in the exhaust duct is measured and evaluated. For this purpose, oxygen measuring probes, so-called lambda probes, are known, which operate, for example, on the principle of ionic conduction through a solid electrolyte as a result of an oxygen partial pressure difference and which emit, in accordance with the oxygen partial pressure prevailing in the exhaust gas, a voltage signal which has a voltage jump during the transition from oxygen deficiency to oxygen excess, and vice versa.

The output signal from the lambda probe is evaluated by a controller which, in turn, adjusts the fuel/air mixture via an actuator.

The primary aim of regulating the fuel/air ratio is to reduce harmful components of the exhaust gas emission of internal combustion engines.

With the aid of a second lambda probe, which is arranged downstream of the catalyst, the signal from the first lambda probe is corrected, since the probe is subject to aging phenomena.

Despite this superposed regulation, the aging phenomena of the first lambda probe cannot be corrected sufficiently.

SUMMARY OF THE INVENTION

The object on which the invention is based is, therefore, to specify a method which allows accurate and adaptable regulation, so that the fuel/air ratio is further improved with the effect of a reduction in the exhaust gas emission.

The object is achieved, according to the invention, in that the correcting signal is weighted as a function of the period of the signal from the first lambda probe.

The advantage of the invention is that the controlled system containing the first lambda probe has superposed on it a manipulated variable which is a function of the actually persisting period of the output signal from the first lambda probe, that is to say the actual fault can be compensated.

Advantageously, a weighting factor is determined from the ratio of the actually measured period of the first lambda probe to the period of the first lambda probe during idling.

In a development of the method, the correcting signal is obtained from the comparison of the actually measured output signal from the second lambda probe with a reference value. In this case, the formation of the correcting signal takes place during each changeover of the lambda probe arranged upstream of the catalyst.

At the same time, the correcting signal is advantageously a holding time, by means of which the output signal from the controller is time-shifted, in particular delayed.

A difference is formed from the actually measured output signal from the second lambda probe and the reference value, said difference being integrated in a sign-related manner at the time of changeover of the first oxygen measuring probe, the integrator value being converted into a time.

Advantageously, the desired value corresponds approximately to the average value of the output signal from the second lambda probe during faultfree operation of the first lambda probe.

In order to set the operating point, the time obtained from the signal from the second lambda probe is corrected as a function of the load and rotational speed of the internal combustion engine and is supplied to the controlled system, in which the fuel injection is adapted.

Numerous exemplary embodiments of the invention are possible.

BRIEF DESCRIPTION OF THE DRAWINGS

With the above and other objects and other advantages in view, the present invention will become more clearly understood in connection with the detailed description of a preferred embodiment, when considered with the accompanying drawings as follows.

DETAILED DESCRIPTION OF THE PREFERRED EMBODIMENT

Figure 1:
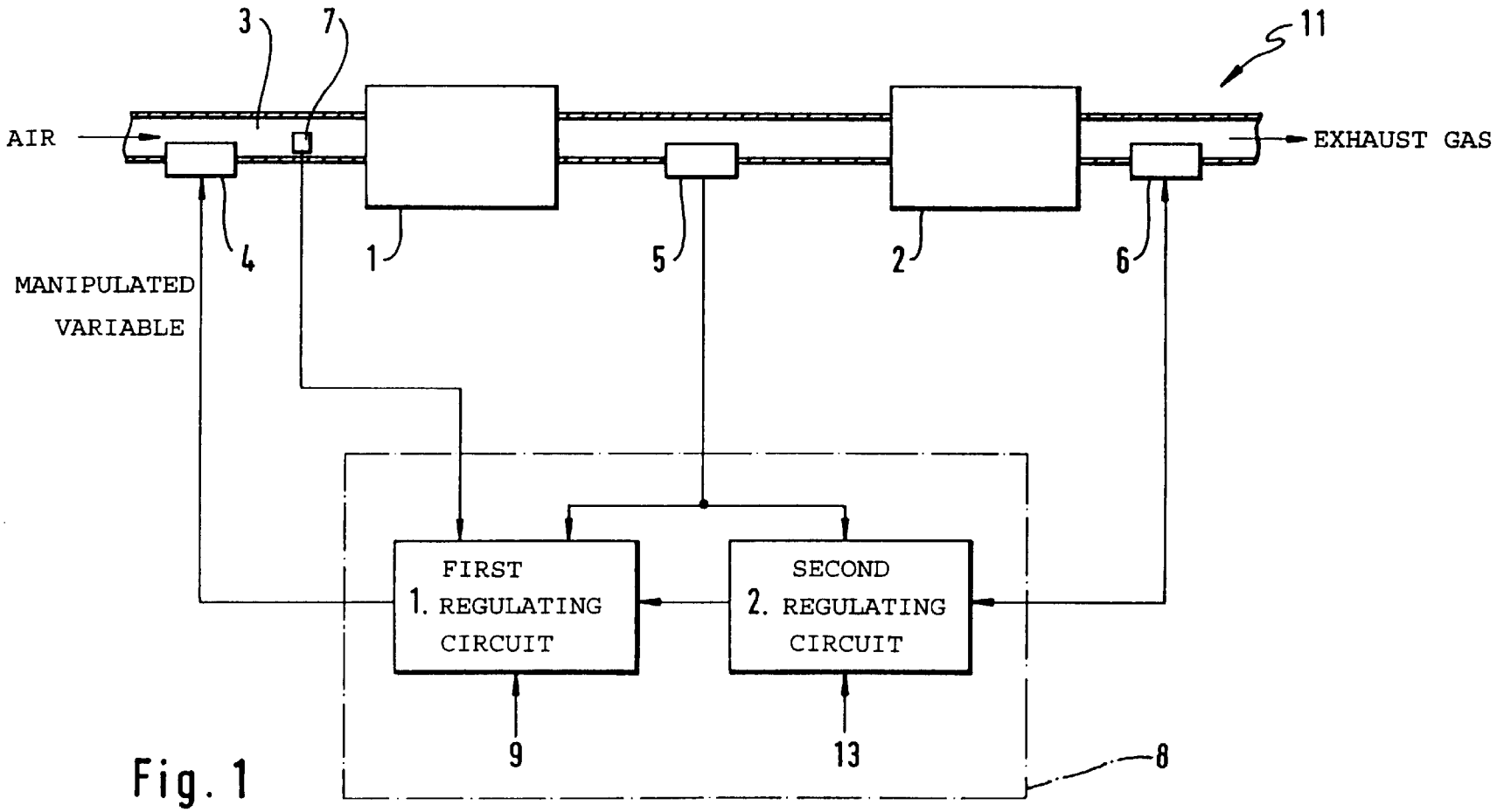
FIG. 1 shows a diagrammatic illustration of a device for regulating the fuel/air mixture of an internal combustion engine.

According to FIG. 1, the device consists of an internal combustion engine 1 with a catalyst 2. Air is supplied to the engine 1 via a suction pipe 3.

The fuel is injected into the suction pipe 3 via injection valves 4.

A first lambda probe 5 for detecting the engine exhaust gas is arranged between the engine 1 and catalyst 2. A further lambda probe 6 is provided in the exhaust duct downstream of the catalyst 2. The lambda probes 5 and 6 measure the respective lambda value of the exhaust gas upstream and downstream of the catalyst 2. The two signals delivered by the lambda probes 5 and 6 are led to a controller having a PI characteristic 8, which is usually arranged in a control unit in the automobile, said control unit not being illustrated in any more detail.

With the aid of desired values 9 and 13, the controller 8 forms from these signals a manipulated variable signal which is supplied to the injection valves 4.

This manipulated variable signal leads to a change in fuel metering, which, together with the intake air mass (air mass meter 7), results in a specific lambda value of the exhaust gas.

Figure 2:
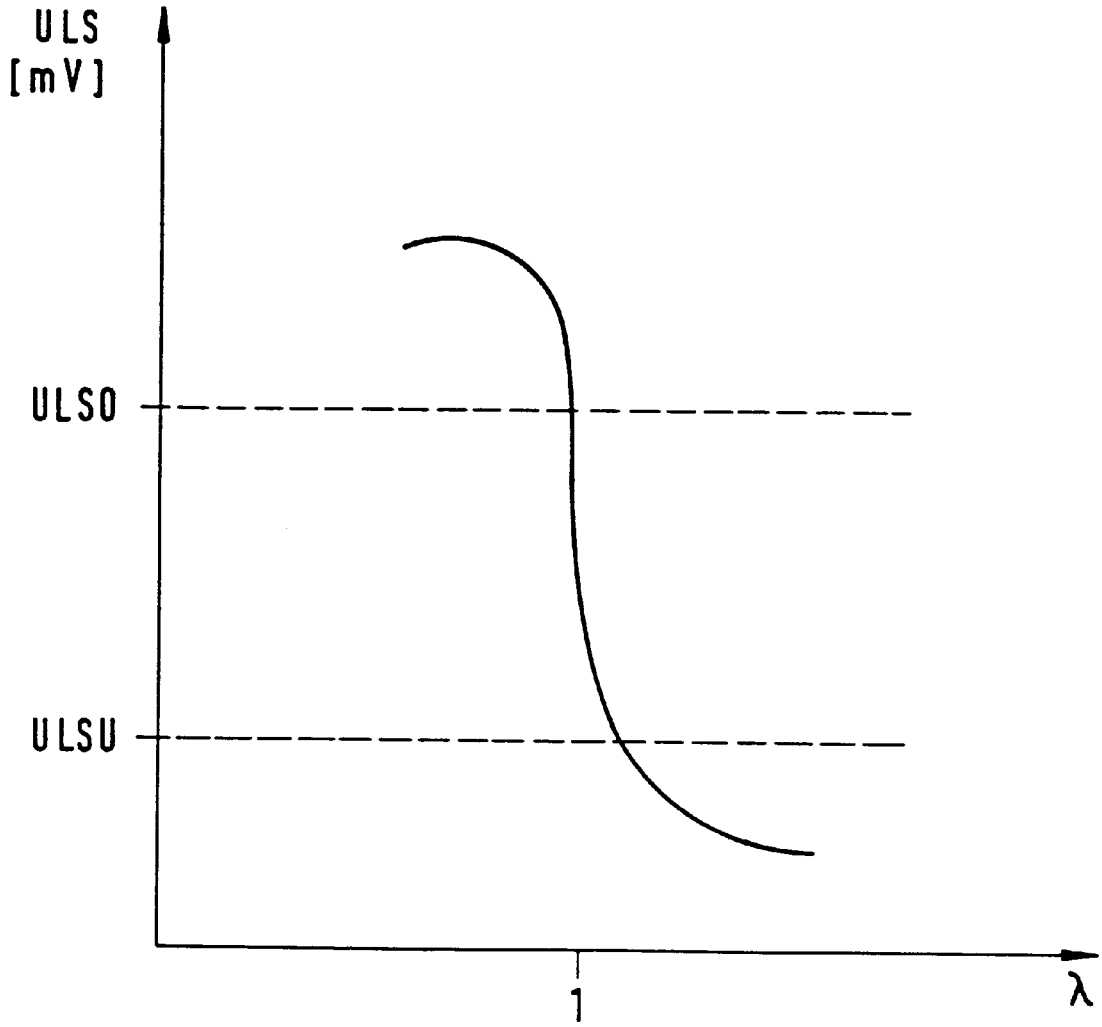
FIG. 2 shows a voltage profile of a lambda probe against the fuel/air mixture (λ-factor).

Each lambda probe delivers a signal profile, as illustrated in FIG. 2, via the λ-factor representing the respective fuel/air mixture. Depending on which type of lambda probe is used for regulation, either the resistance or the voltage may be considered against the λ-factor.

The following statements relate to the signal voltage.

If the probe is active, it has a signal voltage which is outside the range (ULSU, ULSO). During "lean" deflection, the lambda probe delivers a minimum output signal which is below ULSU. During "rich" deflection, a maximum voltage signal above ULSO is measured in a range of 600–800 mV. Due to production tolerances and aging phenomena, this maximum value is subject to some dispersions which are corrected by means of a probe correcting factor.

Figure 3:
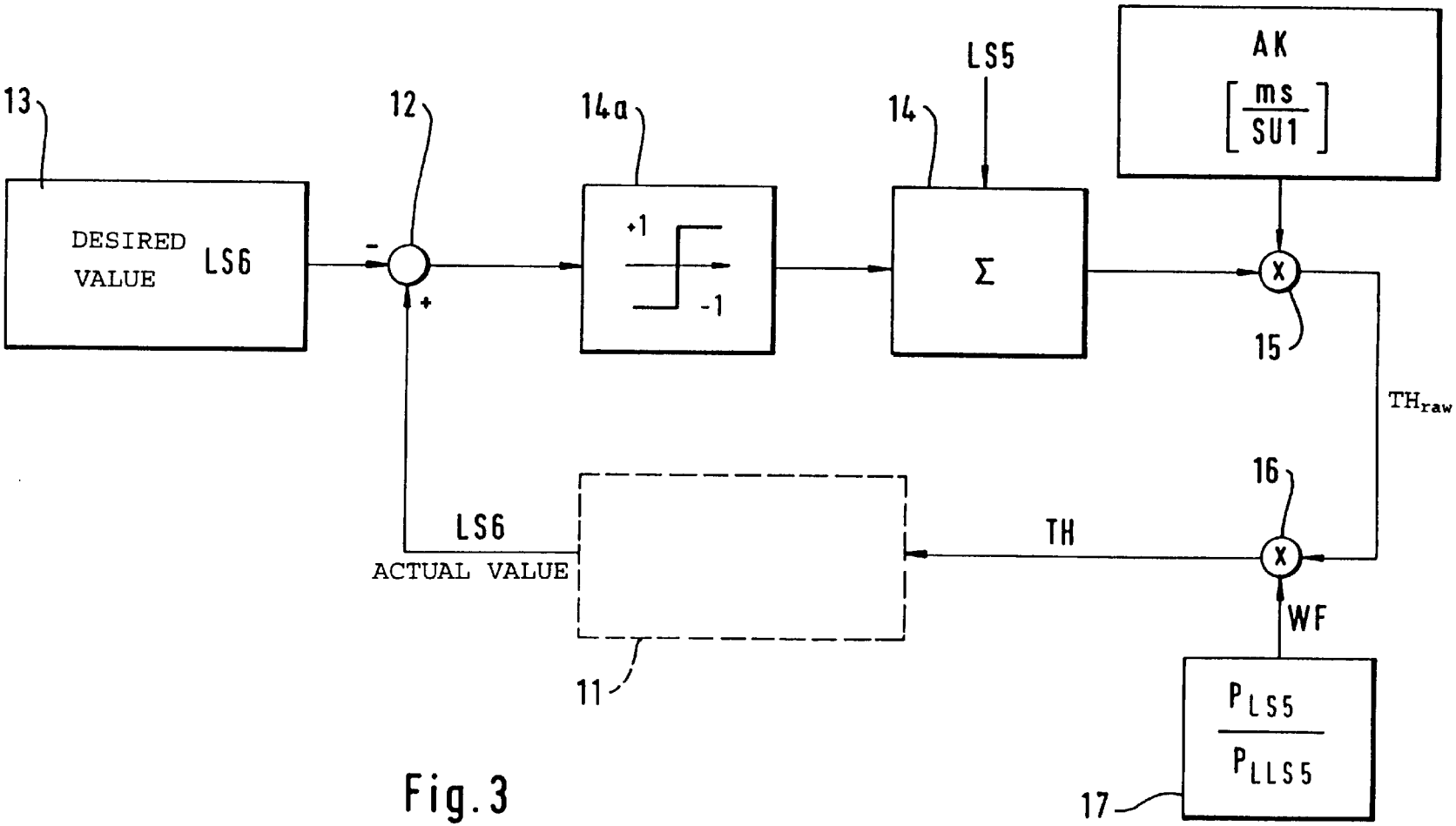
FIG. 3 shows a regulating circuit of the lambda probe arranged downstream of the catalyst.

In order, then, to compensate the long-term drift of the lambda probe 5 upstream of the catalyst, there is a second regulating circuit which contains the second lambda probe 6 downstream of the catalyst 2 and which is explained in more detail in FIG. 3.

As illustrated in FIG. 1, the controlled system 11 contains the injection valves 4, the engine 1, the catalyst 2, the lambda probe 5 and the lambda probe 6. The controller 8 evaluates both the first regulating circuit of the lambda probe 5 (comparison with desired value 9) and the second regulating circuit of the lambda probe 6 (comparison with desired value 13) and, as a result, generates the manipulated variable signal described above.

The lambda probe 6 arranged in the exhaust duct downstream of the catalyst 2 delivers a lambda value in the form of a signal voltage. At the start of each regulating cycle, a check is made as to whether the probe is active. This is carried out by establishing whether this signal voltage is outside a voltage range (ULSU, ULSO) . If this is so, a correcting signal is formed by comparing the actual value $U_{6ACT}$, measured by the lambda probe 6, at a summing point 12 with a desired value 13, stored in a nonvolatile memory of the control unit. This desired value $U_{6DES}$ is formed from the average value measured by the lambda probe 6, when the lambda probe 5 arranged upstream of the catalyst is working in a faultfree manner. A sign reverser 14 with a preceding comparator 14*a* increments by 1 when the actual value $U_{6ACT}$ is higher than the desired value $Y_{6DES}$. It decrements by 1 when the actual value $U_{6ACT}$ is lower than the desired value $U_{6DES}$. If the two values are identical, the count is not changed.

The reverser 14 is processed during each changeover of the lambda probe 5 arranged upstream of the catalyst and is thus clock-controlled by said probe.

At a first multiplying point 15, the count value is multiplied by a proportionality constant having the value of (0.5–a few hundred) ms/changeover of the first lambda probe, with the result that an absolute holding time $TH_{raw}$ is determined. The holding time $TH_{raw}$ thus obtained is evaluated, at a second multiplying point 16, by means of a weighting factor WF which is determined by the division 17 of the actually measured period of the first lambda probe by a constant. In this case, the constant is a function of the period of the first lambda probe during idling.

In comparison with characteristic diagrams used hitherto at this juncture, in which it was possible to assume that the weighting factor had maximum values of 1, the actual fault is now compensated, irrespective of its magnitude, since a kind of self-amplification is achieved by means of the larger factor. The holding time TH thus obtained is supplied as a controlled variable to the controller 8 for the adaptation of the controlled system 11.

The holding time TH delays the P step change of the controller 8.

Figure 4:
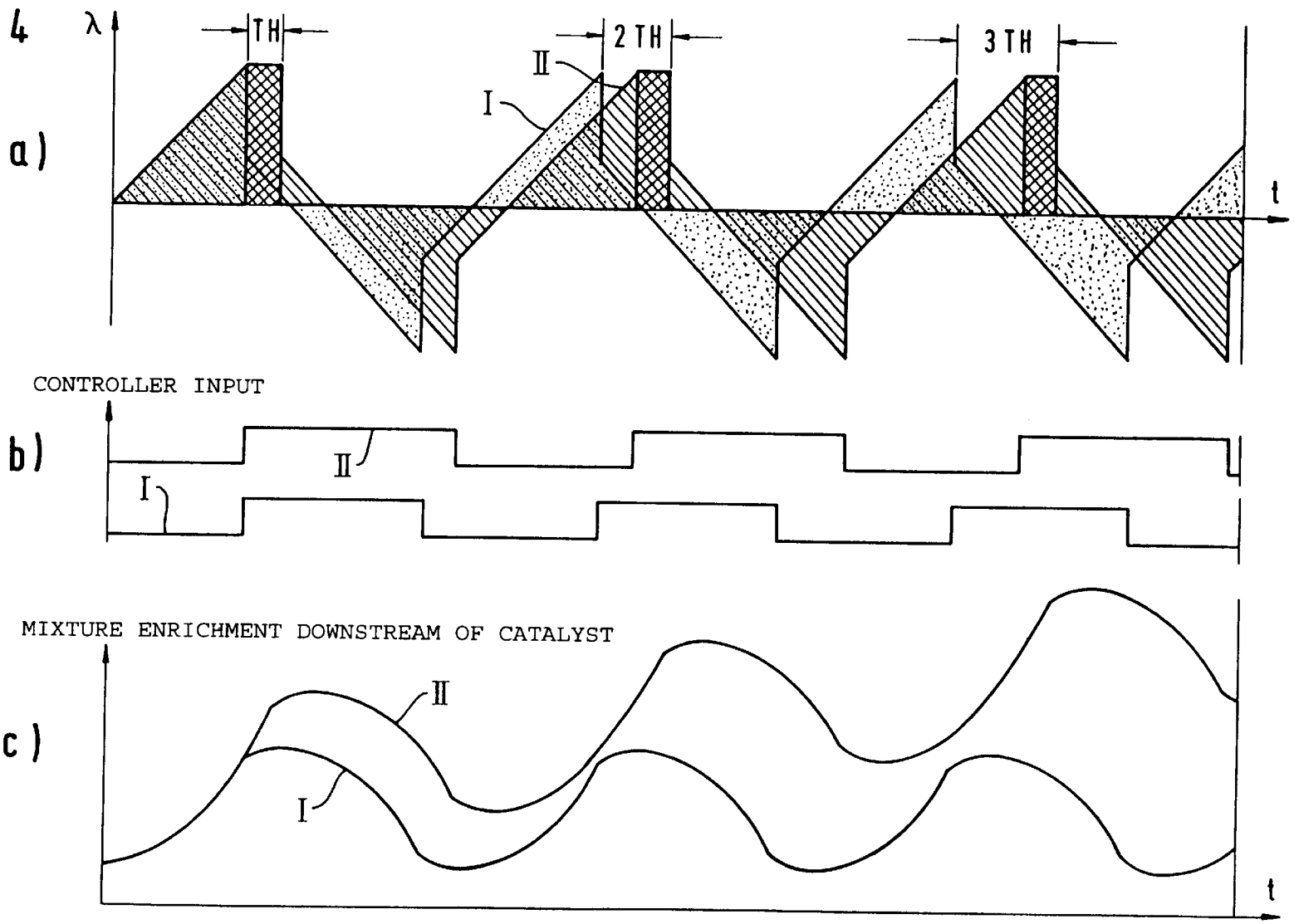
FIG. 4 shows a diagrammatic signal profile of the regulating circuits of the lambda probes upstream and downstream of the catalyst.

For greater clarity, the influence of this regulation on the controlled system 11 is illustrated in FIG. 4.

In this case, the λ regulating factor is plotted against the time.

The curves designated by I (dark areas in FIG. 4*a*) show the time change of the λ regulating factor, without the influence of the regulating circuit of the second lambda probe, while the curves designated by II (hatched area in FIG. 4*a*) illustrate the time change of the lambda regulating factor under the influence of the regulating circuit of the lambda probe arranged downstream of the catalyst.

This illustration is not intended to show a closed regulating circuit, but serves merely to reveal the effect of the holding time TH on the first regulating circuit.

The holding time TH is sign-related, positive times delaying the P step change of the controller after a lean/rich probe changeover and negative times delaying the P step change of the controller after a rich/lean probe changeover of the lambda probe arranged upstream of the catalyst.

Furthermore 4*b* indicates the digitized signal which the first lambda probe transmits to the controller input. It may be gathered from the comparison of curves I and II that the pulse duration of the output signal from the first lambda probe is lengthened under the influence of the second regulating circuit. The result of this is that mixture enrichment downstream of the catalyst increases continuously under the effect of the second λ regulating circuit (FIG. 4*c*).

The results of the method described are stored in the nonvolatile memory of the control unit and are taken into account in the subsequent regulating cycles.

As already mentioned, the maximum voltage signal from a lambda probe is subject to some dispersions which are corrected by means of a probe correcting factor.

The probe correcting factors are determined for both lambda probes 5 and 6 independently of one another by the method described below.

Under full load (that is to say, λ<1), after a first transient recovery time a first measuring time is started, in which the maximum probe voltage $LS_{MAX}$ is determined from the arithmetic average of the measured values.

Similarly, in the coasting mode (λ<1), in a second measuring time the minimum probe voltage $LS_{MIN}$ is determined from the arithmetic average of the measured values obtained during a second measuring time. The second measuring time follows a second transient recovery time. The first and second measuring times may in this case be identical.

After the maximum and minimum probe voltages have been determined, a correcting value is determined separately for each probe once per driving cycle.

$$LS_{Cor} = \frac{LS_{MAX} - LS_{MIN}}{LS_{AMAX}}$$

$LS_{AMAX}$ representing a reference value which is stored in control electronics.

This probe correcting factor LS6Cor is used to determine the corrected desired value $U_{DESCor}$ for the lambda probe 6 arranged downstream of the catalyst:

$$LS_{DESCor} = US_{DES} \times LS6_{Cor}$$

What is claimed is:

1. A method for regulating the fuel/air ratio of an internal combustion engine, comprising the steps of:

supplying an output signal from a first lambda probe, which is arranged in an exhaust duct of the internal combustion engine upstream of a catalyst, to a controller, the controller emitting a manipulated variable for the fuel/air ratio;

measuring a period of the output signal of the first lambda probe under a condition of idling and under a condition of non-idling;

forming a ratio of the period of the first lambda probe signal under non-idling condition to the period of the first lambda probe signal under idling condition, said ratio serving as weighting factor;

supplying to the controller a correcting signal which is obtained from an output signal from a second lambda probe located downstream of the catalyst;

weighting the correcting signal by the weighting factor; and wherein the correcting to be weighted is a holding time by which the output signal from the controller is time-shifted.

2. The method according to claim 1, wherein the holding time is obtained from a comparison of the actually measured output signal from the second lambda probe with a reference value.

3. The method according to claim 1, wherein the holding time is formed during each changeover of the first lambda probe arranged upstream of the catalyst.

4. The method according to claim 2, wherein a difference is formed from the actually measured output signal from the second lambda probe and the reference value, said difference being integrated in a sign-related manner at the time of changeover of the first lambda probe, the integrator value being converted into a time.

5. The method according to claim 4, wherein the reference value represents approximately the average value of the output signal from the second lambda probe during faultfree operation of the first lambda probe.

6. The method according to claim 4, wherein the value of the signal to be supplied to the controller is a function of the operating point of the internal combustion engine.

* * * * *